US006457432B2

(12) United States Patent
Ghignone

(10) Patent No.: US 6,457,432 B2
(45) Date of Patent: Oct. 1, 2002

(54) SELF-PROPELLED APPARATUS FOR GRIPPING, LOCKING IN POSITION AND MOVING UNDERWATER CRAFT AND THE LIKE

(75) Inventor: Stefano Ghignone, Calderara Di Reno (IT)

(73) Assignee: Calzoni S.p.A., Calderara Di Reno (IT)

( * ) Notice: Subject to any disclaimer, the term of this patent is extended or adjusted under 35 U.S.C. 154(b) by 0 days.

(21) Appl. No.: 09/785,623

(22) Filed: Feb. 16, 2001

(30) Foreign Application Priority Data

Feb. 18, 2000 (IT) ..... MI200A291

(51) Int. Cl.[7] ..... B63B 35/44
(52) U.S. Cl. ..... 114/258
(58) Field of Search ..... 114/258, 322

(56) References Cited

FOREIGN PATENT DOCUMENTS

| | | | |
|---|---|---|---|
| DE | 3216051 | 11/1983 | |
| EP | 0532096 | 3/1993 | |
| GB | 2150903 | 10/1985 | |
| JP | 2001199386 A * | 7/2001 | ..... B63B/27/36 |
| WO | WO9729012 | 8/1997 | |

* cited by examiner

*Primary Examiner*—Jesus D. Sotelo
(74) *Attorney, Agent, or Firm*—Ladas & Parry

(57) ABSTRACT

Apparatus for gripping and moving underwater craft and the like (101,102) comprising a crane (103) mounted on-board a ship (100) and provided with articulated arms (1, 2) and a crane cable (214), said crane being connected at its free end to a device (200) for gripping the craft to be recovered, wherein said device (200) essentially consists of:

a head (210) pivotably mounted on the free end of the arm (1) of said crane and able to pivot with respect thereto;

a gripping unit (220) mounted on floats (222) and provided with propulsion means (226) which are controllable by associated means (227) and allow movement of the device parallel to the surface of the water.

15 Claims, 2 Drawing Sheets

SELF-PROPELLED APPARATUS FOR GRIPPING, LOCKING IN POSITION AND MOVING UNDERWATER CRAFT AND THE LIKE

The present invention relates to an apparatus for gripping, locking in position and moving underwater craft and the like, in particular from aboard ships, provided with a self-propulsion device for hitching to the craft to be recovered.

It is known how, at sea, various types of underwater craft are used both for civil and military purposes, being launched onto the water and then recovered from aboard ships equipped for this purpose.

The operations of launching out to sea and recovering these craft are, however, always particularly difficult, because of the difficulty in manoeuvring them, resulting from the impossibility of maintaining a stable relative position between the craft in the water and a hitching device which is normally attached to the ship, due to the movement of the waves which may produce substantial displacement of both the craft and the ship.

This variation in the relative position of the craft with respect to the ship both in the horizontal plane and in the vertical plane therefore complicates the craft gripping operations, very frequently resulting in the need to use personnel in the water who directly perform the operation of attaching the hook of a lifting crane to the craft gripping point; in view of the closeness to the edge of the ship, this results in dangerous and high-risk conditions for said personnel, whose presence in the water is required in particular in bad weather conditions and rough sea conditions which obviously increase further increase the risks.

In the art, some conventional solutions which envisage hitching up the craft by means of a hook situated at the end of a cable which leads to the winch of a crane are known.

These solutions, however, in addition to not allowing gripping of the craft, have the drawback consisting in the fact that, at the moment of lifting of the craft from the water, the said craft is not firmly attached and therefore is able to swing and/or rotate about the vertical axis, increasing the difficulty of manoeuvring for transferral thereof into the parking position on-board the ship; the operating personnel in this case must fasten the craft to other auxiliary means, for example ropes, in order to avoid or reduce these swinging movements and rotations.

This, however, results in other difficulties and risks during the operation in particular when the ship is subject to intense movement. EP 0,532,096 in the name of the same Applicant also discloses an apparatus for gripping, locking in position and moving underwater craft and the like, comprising a crane mounted on-board a ship and provided at its free end with a gripping device, wherein said device essentially consists of a guide element arranged on floats and provided with non-return means for clamping a fixed element attached to the craft to be lifted, as well as means for detecting the position of the mast with respect to the guide, and means for performing movements of the crane arms which, together with the action exerted by the floats, keep a constant distance between the gripping device and the surface of the water and which, together with rotation which can be performed from the crane tower, allow movement of the device parallel to the surface of the water, means also being provided for keeping the device in a vertical position with respect to the ship.

This device has, however, limitations consisting in the need for a dynamic response from the lifting crane, the size of which depends on the weight of the craft to be lifted, which therefore cannot exceed given dimensions since the dynamics of the crane would not be such as to be able to compensate for the relative movements.

In addition to this, the radius of action of the apparatus is limited to the length of the crane arms and consequently the craft to be recovered must be manoeuvred in the vicinity of the hull of the recovery ship so that its gripping element may be introduced with a certain headway into the recovery device, resulting in the risk of collision and damage in particular in rough sea conditions and/or poor visibility.

With the known apparatus, moreover, it is not possible to recover passive floating craft which do not have their own propulsion means.

The technical problem which is posed, therefore, is that of providing an apparatus for hitching to and moving underwater craft and the like, which is able to perform hitching of the craft in the water, with or without its own propulsion means, in a safe manner and without personnel operating in the water, also in the worst conditions as regards weather, rough seas and poor visibility, and which also allows firm gripping and stable positioning of the craft, preventing oscillation and/or rotation thereof.

The apparatus must, moreover, be easy to assemble, also on ships already provided with devices of the conventional type, and able to be converted into auxiliary service apparatus for operations of the conventional type.

These results are obtained by the present invention which envisages an apparatus for gripping and moving underwater craft and the like, comprising a crane mounted on-board a ship and provided with articulated arms and a crane cable, said crane being connected at its free end to a device for gripping the craft to be recovered, wherein said device essentially consists of a head pivotably mounted on the free end of the arm of said crane and able to pivot with respect thereto; and a gripping unit mounted on floats and provided with propulsion means which are controllable by associated means and allow movement of the device parallel to the surface of the water.

Further details may be obtained from the following description, with reference to the accompanying drawings, in which.

Figure 1:
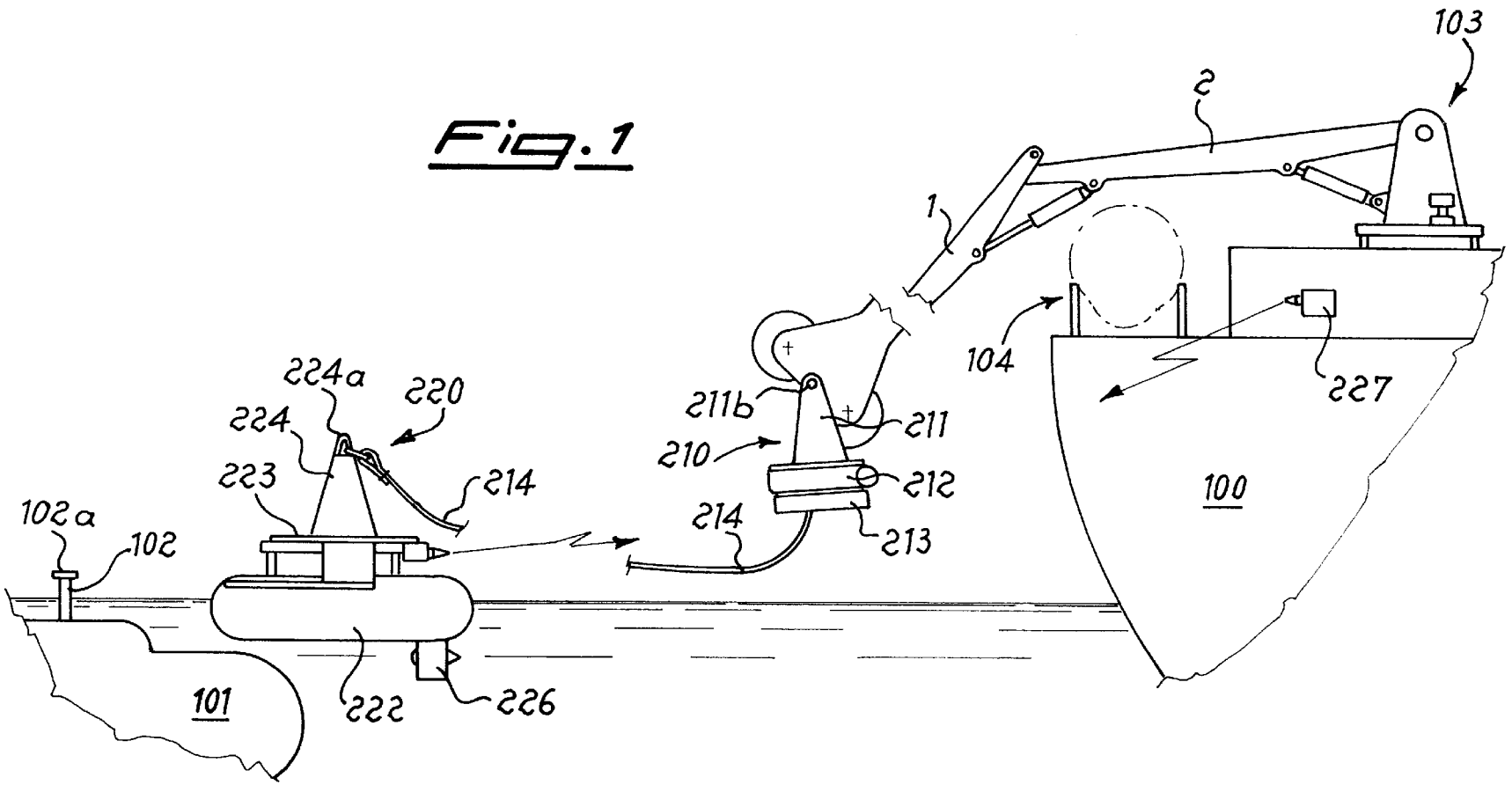
FIG. 1 shows a schematic view of the gripping and moving apparatus mounted on a ship.
Figure 2:
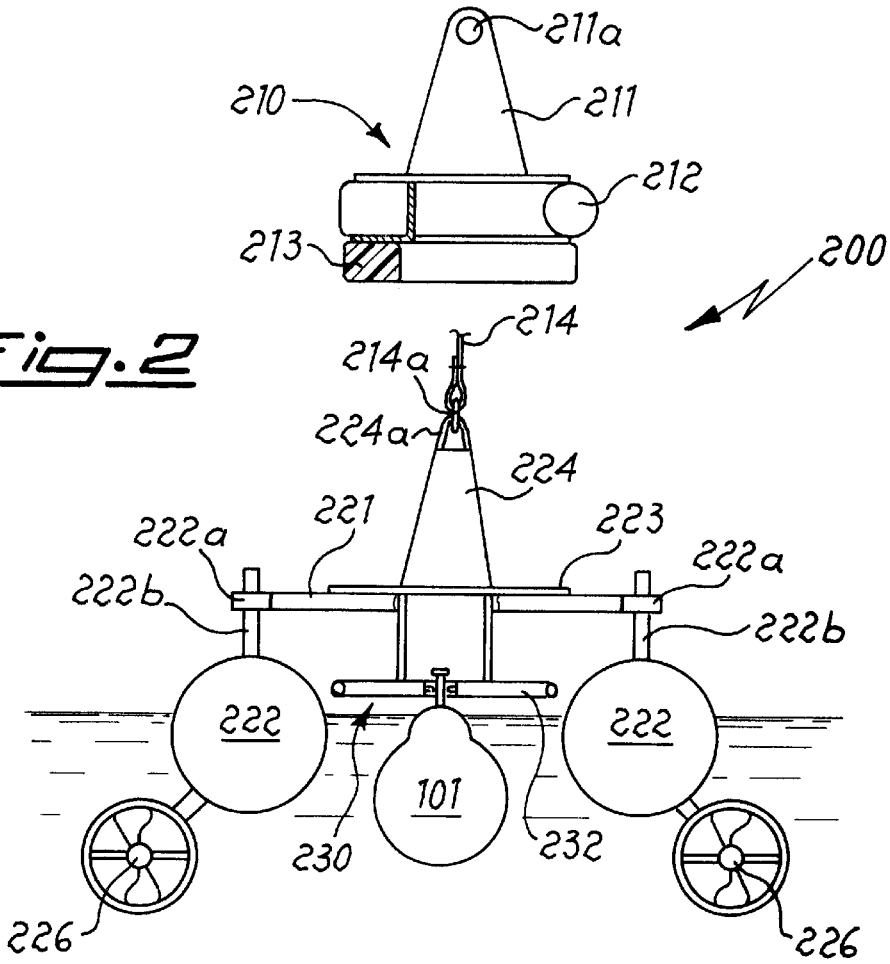
FIG. 2 shows a front view of the gripping device according to the invention.

As shown in FIG. 1, a crane 103, which is known per se and therefore only illustrated but not described in detail, is installed on-board a ship 100.

The gripping device 200, consisting of a hollow pivoting head 210 pivotably mounted on the said free end of the crane arm and a gripping unit 220 able to float on the water, is joined to the free end of the arm 1 of the crane 103.

In greater detail, said pivoting head 210 consists of a top part essentially consisting of two flanges 211 provided with a hole 211*a* by means of which they are attached to a pin 211*b* for connection to the crane arm. On the opposite side to that of the pin 211*b*, said top part of the head is connected to an internally hollow rotating actuator 212 underneath which a ring of plastic material 213 with a high coefficient of friction is fixed; said rotating actuator and elastic ring are respectively designed to impart a rotational movement to the said device about its longitudinal axis and prevent relative movements between the parts.

The devices for actuating rotation may be of the electrical and/or hydraulic type powered by means of cables or flexible pipes departing from the arm 1 of the crane 103.

The hollow pivoting head 210 receives, inside it, with ample play, the crane cable 214, one end of which is connected to recovery/release means attached to the said crane 103 and the free end of which can be connected to a device 220 for gripping the craft 101 to be recovered.

Said gripping unit 220 consists of a load-bearing structure 221 which has, connected to it, two floats 222 by associated means 222*a*,222*b* designed to allow adjustment of the distance, from the free water surface, of the whole assembly connected to the structure 221.

The top part of the structure 221 also has, arranged on it, a circular plate 223 on which there is mounted a conical support 224 provided at its free top end with a ring 224*a* to which the cable 214 of the crane may be attached by means of a known device 214*a*.

Each of said floats 222 is equipped with a propeller 226 which is operated by an actuator preferably consisting of an electric motor which is known per se and not illustrated.

The two motors, and therefore the two propellers 226, may be remotely operated, one independently of the other one, by means of a remote control device 227 arranged on-board the ship and operated by the operator and/or by an automatic control device.

On the part of the structure opposite to said conical element 224, the plate has, attached to it, the actual element 230 for guiding and hitching up the craft 101, the distance of which from the free surface of the water may be adjusted by said means 222*a*, 222*b* for adjusting the distance of the device 230 from the free surface of the water.

Said guiding and hitching element 230 consists of a substantially V-shaped element 232 which terminates at its vertex in a slot 232*a*.

Figure 3:
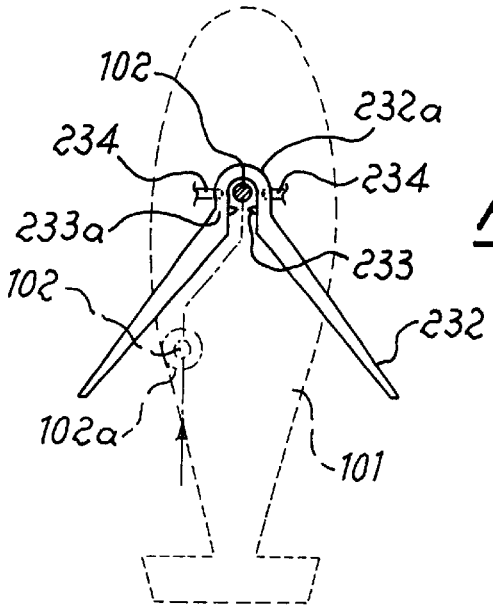
FIG. 3 shows a cross-section along the plane III—III in FIG. 2.

At the inlet to the slot 232*a* the V-shaped element has (FIG. 3) two pawls 233 which are hinged on pins 233*a* about which they are able to rotate; the pawls 233 are normally kept in the closed position by a spring which is known per se and not illustrated and against the thrusting action of which the said pawls may open towards the inside of the slot 232 both owing to the thrust exerted by a body which makes contact and following operation by the operator.

The hitching device 230 is also equipped with two locking devices 234 which, as will be described further below, are designed to clamp a post 102 attached to the craft 101 once it has been manoeuvred into the gripping position. Said cylindrical post 102 advantageously has a disk 102*a* at its top free end.

The operating principle of the apparatus is as follows:

the underwater craft 101, which is brought to the surface by its own means, is positioned at a safe distance from the ship 100;

the height of the gripping unit 230 is adjusted by means of the said cylinder 231 so as to position it at a distance from the surface of the sea, suitable for engagement with the corresponding post 102 of the craft 101;

the operator on-board the ship hitches up the cable 214 of the crane to the gripping/recovery unit 220 and, by means of a suitable manoeuvre performed by the crane, lifts the said unit, depositing it on the surface of the water and leaving a certain amount of loose cable so that that relative movements between the ends of the crane and the water surface do not lift the unit from the water;

once it has been deposited on the surface of the water, the unit 220 remains afloat owing to the effect of the floats 222;

the operator on-board the ship, by means of the remote control device 227, activates the motors of the propellers 226, causing the gripping unit 220 to move towards the craft 101, while the crane releases cable 214 accordingly;

owing to the V shape of the guide element 232, the unit 220 may easily locate and guide the post 102 towards the slot 232*a* inside which it is trapped by means of the pawls 233 and firmly held by means of the locking devices 234 to prevent rotational and/or deviating movements;

at this point the crane operator starts to reel in the cable 214 until the gripping unit and craft are brought into a position substantially coaxial with the pivoting head 210;

As more cable 214 is reeled in, the conical element 224 is inserted between the two supports 211 of the head 210, being centred with respect to the hole in the actuator 212 until the plate 223 comes into contact against the elastic ring 213.

In this situation, co-operation between the conical surfaces of the element 224 and the hollow head 211 prevents any major relative oscillating movements, while the friction between the plate 223 and the elastic element 213 prevents relative rotational movements, allowing safe lifting and recovery of the craft 101 so as to deposit it in its parked position 104 on-board the ship.

During this lifting operation the rotating actuator 213 may be suitably actuated so as to orient the craft correctly before it is deposited in the parking position.

Many variations may be made to the constructional embodiment of the component parts of the apparatus without thereby departing from scope of the invention with regard to its general features; in particular it is envisaged that the gripping unit may be equipped with a power supply battery and a radio control receiving device able to receive control and actuating commands in order to make the device more autonomous, allowing recovery at greater distances.

The actuator of the various devices 233 and 234 may be electric or hydraulic; in the latter case a hydraulic power source is provided on-board the device 220.

It is envisaged moreover that adjustment of the height of the gripping device from the free surface of the water may be performed manually or by means of electrical or hydraulic motor systems.

In addition it is envisaged that the gripping element 230 may be equipped with sensors, for example of the optical or laser type, for detecting the gripping post 102 attached to the craft 101, and with an automatic guiding device which, upon receiving signals from said sensors, allows engagement with the post on the craft even in conditions where there is poor or zero visibility.

What is claimed is:

1. Apparatus for gripping and moving underwater craft comprising:

a crane mounted on-board a ship and provided with articulated arms and a crane cable, said crane being connected at its free end to a device for gripping the craft to be recovered;

a head pivotably mounted on the free end of the arm of said crane and able to pivot with respect thereto; and a gripping unit mounted on floats and provided with propulsion means which are controllable by associated means and allow movement of the device parallel to the surface of the water.

2. Apparatus according to claim 1, wherein said pivoting head comprises an internally hollow part for connection to said crane.

3. Apparatus according to claim 2, wherein said pivoting head comprises a ring made of elastic material with a high co-efficient of friction, arranged coaxially with said internally hollow part.

4. Apparatus according to claim 2, wherein said pivoting head comprises a rotating actuator arranged coaxially with a conical part.

5. Apparatus according to claim 1, wherein said floats are connected to a support structure of the gripping unit by means of the intervening arrangement of means for adjusting the height of the support structure from the free surface of the water.

6. Apparatus according to claim 1, wherein said propulsion means consist of a propeller which is connected to each float and can be actuated by means of an associated actuator device which can be remotely controlled by associated means.

7. Apparatus according to claim 1, wherein said gripping unit comprises a conical element extending upwards from the structure of the said unit and designed for coupling with said internally hollow part attached to the arm of the crane.

8. Apparatus according to claim 7, wherein said conical element is provided with a ring for hooking up to the said crane cable.

9. Apparatus according to claim 1, wherein said gripping unit comprises a guiding and gripping element which is substantially V-shaped and at the vertex of which there is formed a slot at the inlet of which non-return means are provided.

10. Apparatus according to claim 9, wherein said non-return means comprise a pair of pawls which are hinged on pins arranged vertically and able to rotate towards the inside of the slot as a result of the thrusting action of means for hitching the craft and against the thrusting action of elastic means designed to keep the pawls in a closed position, there also being provided members for recalling the said pawls for controlled opening thereof.

11. Apparatus according to claim 1, wherein a guiding element envisages means for clamping a hitching means of the craft comprising pairs of opposite devices attached to the guiding element in the region of a slot so as to exert an action clamping the hitching means, locking them in rotation relative to a gripping device.

12. Apparatus for gripping and moving underwater craft according to claim 1, wherein a hitching means attached to the craft comprises a vertical post which is joined at the top to a horizontal disk which is designed to prevent said post from escaping downwards when it has been inserted into a slot of a guiding element.

13. Apparatus according to claim 1, wherein said means for controlling the propulsion means of the gripping unit comprise a remote control device.

14. Apparatus according to claim 1, wherein the gripping unit comprises at least one power supply battery.

15. Apparatus according to claim 1, further comprising sensors for detecting a hitching means attached to the craft.

* * * * *